US007090460B2

(12) United States Patent
Engländer et al.

(10) Patent No.: US 7,090,460 B2
(45) Date of Patent: Aug. 15, 2006

(54) PUMP EMBODIED AS A SIDE CHANNEL PUMP

(75) Inventors: Heinrich Engländer, Linnich (DE); Peter Klingner, Köln (DE); Ingo Seckel, Bornheim (DE)

(73) Assignee: Leybold Vakuum GmbH, Cologne (DE)

( * ) Notice: Subject to any disclaimer, the term of this patent is extended or adjusted under 35 U.S.C. 154(b) by 110 days.

(21) Appl. No.: 10/398,021

(22) PCT Filed: Sep. 28, 2001

(86) PCT No.: PCT/EP01/11260

§ 371 (c)(1),
(2), (4) Date: Mar. 28, 2003

(87) PCT Pub. No.: WO02/31360

PCT Pub. Date: Apr. 18, 2002

(65) Prior Publication Data

US 2003/0185667 A1 Oct. 2, 2003

(30) Foreign Application Priority Data

Sep. 30, 2000 (DE) ..... 100 48 695

(51) Int. Cl.
*F01D 1/02* (2006.01)
*F03B 1/00* (2006.01)
*F03D 5/00* (2006.01)

(52) U.S. Cl. ..... 415/54.1; 415/55.5; 415/55.6; 416/177

(58) Field of Classification Search ..... 415/54.1, 415/55.1, 55.5, 55.6, 57.2, 57.3, 72, 73; 416/177, 416/176

See application file for complete search history.

(56) References Cited

U.S. PATENT DOCUMENTS

| | | | | |
|---|---|---|---|---|
| 1,760 | A * | 7/1840 | Smith | 418/206.4 |
| 503,550 | A * | 8/1893 | McElroy | 415/75 |
| 915,451 | A * | 3/1909 | Lindner | 415/57.2 |
| 1,031,757 | A * | 7/1912 | Westinghouse | 415/57.3 |
| 3,066,849 | A | 12/1962 | Beams | |
| 3,324,799 | A | 6/1967 | Terrano | |
| 3,917,431 | A | 11/1975 | Rose | |
| 4,306,833 | A * | 12/1981 | Sixsmith et al. | 415/55.4 |
| 4,645,413 | A * | 2/1987 | Reich | 415/72 |
| 4,678,395 | A | 7/1987 | Schweinfurter | |
| 4,735,550 | A | 4/1988 | Okawada et al. | |
| 5,642,981 | A * | 7/1997 | Kato et al. | 415/55.1 |

FOREIGN PATENT DOCUMENTS

| | | |
|---|---|---|
| EP | 170 175 | 2/1986 |
| EP | 477 924 | 4/1992 |
| GB | 322879 | 7/1930 |

* cited by examiner

*Primary Examiner*—Theresa Trieu
(74) *Attorney, Agent, or Firm*—Fay, Sharpe, Fagan, Minnich & McKee, LLP

(57) ABSTRACT

A side channel pump, preferably a vacuum pump, includes a driven rotor (16) and a fixed stator (14). The rotor (16) and the stator (14) define a pump channel circulating in a peripheral direction. Blades are fixed onto the rotor, protruding into the cross-section of the pump channel. The pump channel also includes a blade-free side channel (44). The pump channel (22) containing the side channel (44) extends in a helical manner around the rotor (16). The pump channel is advantageously not limited to the length of a winding but can have the length of substantially any number of uninterrupted windings. As a result, a high suction performance and a high compression ratio in the pump can be obtained.

17 Claims, 8 Drawing Sheets

FIG.6
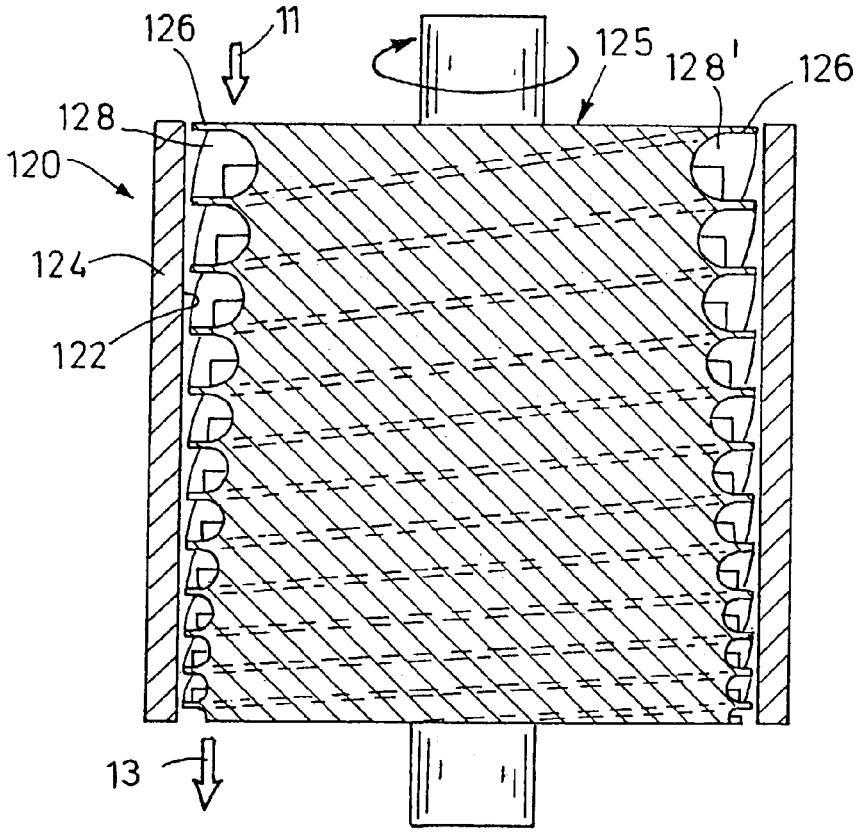
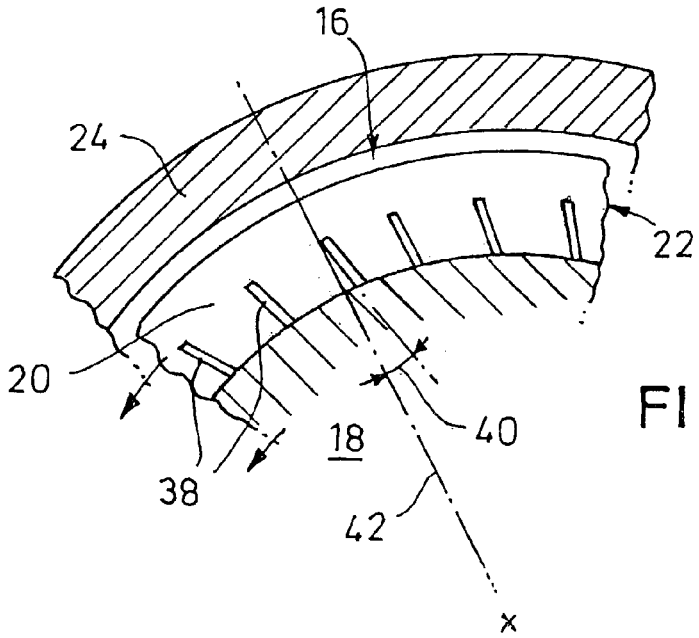
FIG.2b

PUMP EMBODIED AS A SIDE CHANNEL PUMP

BACKGROUND OF THE INVENTION

The invention relates to a side channel pump for supplying liquid and gaseous fluids as well as mixtures of liquid and gas.

Among other things, side channel pumps are used for generating a vacuum. From EP-A-0 170 175, a side channel vacuum pump is known that includes several annularly extending pump channels limited by the rotor and by the stator each. At the rotor, blades are arranged, protruding into the respective pump channel cross-section. From radially inside, the blades protrude only into a portion of the pump channel cross-section so that the radial outer portion of the pump channel is free of blades. The blade-free portion of the pump channel is the side channel.

During rotation of the rotor, the fluid molecules are seized by the blades and accelerated in circumferential direction. Due to the centrifugal force, the fluid molecules are moved outward into the blade-free side channel. In the side channel, the radially outward directed movement is again deflected radially inward in the direction of the blades, the fluid molecules being strongly braked again by the friction at the fixed stator wall. The fluid molecules leave the side channel in a radially inward direction and are seized by the blades again and accelerated in circumferential direction. Through this continuously repeating process, a circumferentially moving helical fluid whirl develops in the pump channel.

The fluid inlet and the fluid outlet are formed by a stop wall radially protruding from the stator into the blade-free cross-sectional area of the side channel. In the region of the stop wall, the incoming fluid flow passes out of the blade-free cross-sectional area of the pump channel to a fluid outlet. The portion of the fluid in the region of the blades at that time is not seized by the stop wall and is therefore entrained by the blades to the fluid inlet at the rear side of the stop wall.

The compressed fluid entrained to the suction side expands again to the suction pressure on the suction side and is compressed again. This means that, in the region of the blades, the pump channel forms a short circuit between the pressure side and the suction side of the annular-like pump channel. The pressure losses caused in this manner produce heating and noise. In a vacuum pump, several such annular pump channels are connected in series or combined with another molecular pump stage, with a turbomolecular pump stage, for example, for generating high degrees of compression. Because of their simple mechanical structure, ease of maintenance, and reliability, side channel pumps are well suited for industrial use. Due to the plurality of loss-inflicted fluid inlets and outlets, however, the suction capacity and the compression ratio are limited.

The present invention contemplates an improved apparatus and method that overcomes the aforementioned limitations and others.

SUMMARY OF THE INVENTION

One advantage of the invention is improved compression in the side channel pump.

In one embodiment of the invention, the pump channel no longer extends like a screw thread about the rotor, rather than in an annular fashion. In this arrangement, the pump channel can comprise more than one winding, that is, the channel can include a plurality of windings. Moreover, the maximum pump channel length is not limited to one a single rotor circumference but, due to the helical arrangement, can be extended to a multiple of the rotor circumference and is just limited by the axial rotor length. The pump channel can extend continuously over a length of a plurality of windings without the pump channel being interrupted by loss-inflicted fluid inlets and outlets. Therefore, an undisturbed helical fluid flow develops in the pump channel over the entire pump channel length. Thus, a high compression of the pump is realized. Because of the omission of a plurality of fluid inlets and outlets, the noise emission is reduced as well.

The stator is configured as a surface area of a body of revolution. For example, the stator can be cylindrical, conical or parabolic. Therefore, the stator has a simple structure and can be produced inexpensively. An easily maintained side channel pump is realized that has a high compression and suction capacity, generates a fluid flow of low pulsation level, occupies a small installation space and is adapted to be produced easily and inexpensively. Since no oil seals are required, a fluid is delivered that is free of contaminations.

According to a preferred embodiment of the invention, the rotor comprises a channel wall laterally defining the pump channel, extending helically about the rotor. In the region of the pump channel, the stator is configured so as to have a smooth surface. Most walls of the pump channel are provided at the rotor side, i.e., they are moved in the pumping direction. Therefore, the fluid molecules are braked only at a single wall of the pump channel, namely at the wall formed by the stator. By this arrangement, the suction capacity of the pump is increased as well.

According to a preferred embodiment, the pump channel extends continuously over approximately the entire rotor length. The fluid inlet and outlet are provided at the end faces of the rotor, respectively. This means that a single self-contained compression stage extends over a plurality of windings over the entire length of the rotor. The front-face fluid inlet and the front-face fluid outlet are spatially separated from each other; this means that between the compression side and the suction side, there is no short circuit causing a pressure loss. With a single compression stage, a high compression and suction capacity can thus be realized.

According to a preferred embodiment, the rotor comprises several channel walls defining several pump channels parallel to each other. Hence, it is a multiple side channel pump having a correspondingly high suction capacity.

Preferably, the cross-sectional area of the blades amounts to between one fifth and half of the cross-sectional area of the pump channel.

According to a preferred embodiment, the stator surrounds the rotor. Alternatively or in combination therewith, the rotor can also surround the stator. Particularly by the combination of both structural shapes in a single rotor or stator, a very compact pump can be realized.

According to a preferred embodiment, the channel wall is arranged so as to be inclined to a radial line of the rotor, namely inclined in the direction of discharge. This means that the channel wall does not protrude vertically from a cylindrical rotor, but is inclined towards the pressure side. That channel wall of a pump channel that is the rear one in discharge direction has an obtuse angle of more than 90° with respect to the fixed stator-side channel wall so that the channel wall located at the rear acts like a scraper scraping the fluid off the stator channel wall and supporting the formation of the helical fluid whirl in the pump channel.

According to a preferred embodiment, the blades are arranged so as to be inclined to the radial line of the rotor. This means that the blades do not project vertically from a cylindrical rotor but are inclined in the direction of the channel towards the pressure side. Due to the blades being inclined forwards to the pressure side, the flow component of the fluid in discharge direction is increased, whereby the fluid pressure is simultaneously increased.

Preferably, the pump channel cross-section is larger at the suction-side end than at the pressure-side end of the rotor. The fluid increasingly compressed towards the pressure side is delivered in correspondence with its compression in a pump channel with a decreasing cross-section. Thus, the pump channel length is capable of being considerably lengthened, with the axial rotor length remaining constant. In this way, the rotor length can be kept relatively short so that a compact structure of the vacuum pump is realized.

According to a preferred embodiment, the pump channel comprises a radial step. The height of a radial step of the pump channel may be smaller than half the pump channel height. The stepwise reduction of the pump channel radius causes a reduction of the circumferential rotor speed, with the fluid compression increasing. Thereby, the friction losses between the rotor-side channel walls and the stator-side channel walls are reduced. Due to the limitation of the radial pump channel step to half the pump channel to height, the preservation of the helical whirl is ensured when the fluid transitions from one pump channel section into the next pump channel section. In this way, the pressure losses in the radial step are kept small. In the respective pump channel sections, the pump channel is still arranged helically.

According to a preferred embodiment, the rotor-side pump channel wall and the rotor have a conical configuration. Thus, the cross-sectional area of the pump channel can be reduced in correspondence with the pressure increase in the pump channel towards the pressure side. Further, the circumferential rotor speed is reduced towards the pressure side by reducing the outer diameter of the rotor. The geometry of the pump channel is adapted to the curve of the fluid pressure. Thus, a very compact structure and a rotor operation in the stator at a low friction level can be realized.

Preferably, a fluid cooling channel is provided that is arranged between two pump channel sections. In this way, an intermediate cooling of the fluid is effected. The fluid is led out of the pump channel by a scraper projecting into the pump channel, for example, and cooled in a cooled cooling channel and subsequently supplied to a following pump channel section again. Due to the intensive cooling of the fluid in an external cooling channel, the heating of the fluid as well as that of the rotor and the stator is limited. In this way, the compression process approximates isothermal compression, and the input power is reduced.

According to yet another preferred embodiment, the pump channel is arranged at an end face of the rotor, the pump channel including the side channel extends spirally on the rotor end face. Moreover, the pump channel can also be arranged on a rotor in the form of a spiral instead of in the form of a helix. Thus, it is also possible to realize a pump channel with several windings which are not interrupted by fluid inlets and outlets. The pump channel extends in a logarithmic spiral or evolvent. The suction side of the pump channel may be arranged on the outside or in the center of the rotor or stator.

The aforementioned features referring to a pump with a pump channel on the outside of a rotor can also be applied, in a similar or analogous manner, to the pump in which the spiral pump channel is arranged on the rotor end face.

Numerous advantages and benefits of the present invention will become apparent to those of ordinary skill in the art upon reading the following detailed description of the preferred embodiments.

BRIEF DESCRIPTION OF THE DRAWINGS

The invention may take form in various components and arrangements of components, and in various process operations and arrangements of process operations. The drawings are only for the purpose of illustrating preferred embodiments and are not to be construed as limiting the invention.

FIG. 2*b* shows a cross-sectional top view of one of the pump channels of the pump of FIG. 1.

FIG. 6 shows a fourth embodiment of a side channel pump with a pump channel the cross-section of which reduces towards the pressure side.

DETAILED DESCRIPTION OF THE PREFERRED EMBODIMENTS

Figure 1:
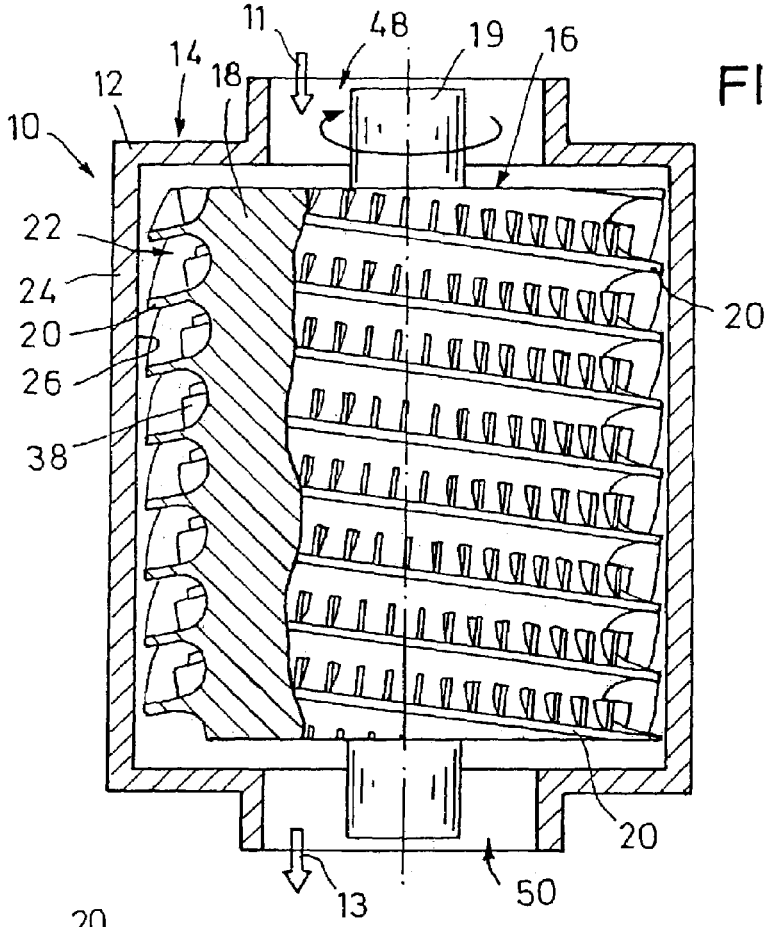
FIG. 1 shows a longitudinal cross-sectional view of a first embodiment of a side channel pump with a cylindrical rotor and a cylindrical stator.

In FIG. 1, a first embodiment of a pump 10 which is a side channel pump, for delivering a fluid, and preferably for delivering a gas, is illustrated. The pump 10 serves to produce a vacuum on a suction side 11 and to compress the fluid into medium vacuum or rough vacuum on a pressure side 13.

The side channel vacuum pump 10 is substantially formed by a stator 14 forming a fixed housing 12 and a driven rotor 16 in the stator housing 12. The rotor 16 is driven by an electric motor (not shown) by which the rotor 16 can be rotated at up to 80,000 revolutions/minute. The rotor 16 and the stator housing 12 are preferably made of metal, but may also be made of ceramics, be made of plastics or of a material coated with plastics. The operation of the vacuum pump 10 is preferably lubricant-free so that a contamination of the pumped fluid is avoided.

From the suction side 11 of the vacuum pump 10, the fluid flows through a fluid inlet 48 into the stator housing 12 at the one end face of the rotor 16 and flows through a fluid outlet 50 out of the stator housing 12 towards the pressure side 13 at the other end face of the rotor 16 in a compressed manner.

The rotor 16 includes an integral rotor body 18 with a shaft 19 and has, disposed at its outer circumference, a single channel wall 20 projecting radially outward, extending over the axial length of the rotor 16 in the form of a helical line with a constant gradient. The helical thread formed in this way is a single-flight thread. Over the entire rotor length, the channel wall 20 defines therebetween a single pump channel 22 extending helically around the rotor circumference.

Figure 2A:
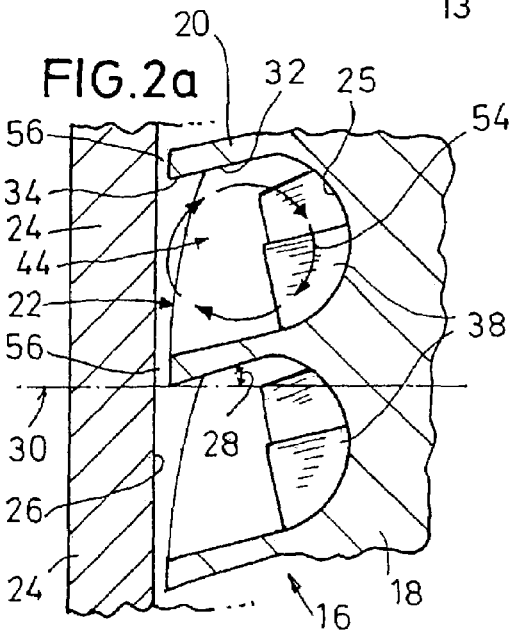
FIG. 2*a* shows a an enlarged cross-sectional view of the pump channels of the pump of FIG. 17.

With continuing reference to FIG. 1 and with further reference to FIG. 2*a*, in cross-section, a channel bottom 25 formed by the rotor body 18 has an approximately circular configuration. On the outside or stator side, the pump channel 22 is defined by a cylindrical housing wall 24 of the housing 12. An inside 26 of the housing wall 24 is preferably smooth. The pump channel 22 extends in a single winding over the entire length of the rotor 16.

As illustrated in FIG. 2*a*, the channel wall 20 is inclined to a radial line 30 of the rotor 16 at an angle 28 of approximately 15°. The channel wall 20 is inclined such that it is axially bent forward towards the pressure side 13. A pressure-side side 32 of the channel wall 20 that forms the suction-side wall of the pump channel 22 assumes an obtuse angle with respect to the stator-side inside 26 of the housing wall 24. A pressure-side front edge 34 of the channel wall acts like a scraper with respect to the inside 26 of the housing wall 24 and thus peels fluid off the housing inside 26.

In the pressure-side and rotor-side quarter of the pump channel cross-section, a plurality of plate-like blades 38 is arranged at an equal mutual distance. The blades 38 shaped like segments of a circle assume about between a fifth and a half of the cross-sectional area of the pump channel, but may also be larger. The blades 38 are arranged in the region of the suction-side and rotor-side quarter of the channel cross-section. As illustrated in FIG. 2*b*, each blade 38 stands at about right angles to the channel wall 20 and at an angle 40 of 10°–20° to a radial line 42 of the rotor body 18. Due to the forward inclination of the blade 38 in rotational direction or to the pressure side to the fore, the pressure generated in the fluid is increased in comparison with blades without inclination. The blades 38 bent forward in rotational direction effect an increased flow component that is directly proportional to the increase in pressure.

The blade-free stator-side half of the pump channel 22 forms a side channel 44 of the pump channel 22. The side channel 44 of the pump channel 22 is the outside and blade-free portion of the pump channel 22.

A gap 56 between the channel wall 20 and the inside 26 of the housing wall 24 is sufficiently small so that the backflow caused by the pressure difference between neighboring pump channel passages is substantially smaller than the pressure difference built up in a winding. The flow resistance of the gap 56 is large, such that it is an obstacle to a considerable fluid backflow in the direction of the suction side 11. The flow resistance in the gap 56 can be changed by using a thicker a channel wall 20 and thus a corresponding axial lengthening of the gap 56.

The fluid flows through the fluid inlet 48 into the stator housing 12 and is accelerated by the channel wall 20, the channel bottom 25, and the blades 38 and thus, is tangentially compressed in the circumferential direction into the circumferential pump channel 22 and simultaneously delivered axially towards the fluid outlet. In the closed helical pump channel 22, the fluid or the fluid molecules are moved on a helical line within the pump channel 22.

Figure 3:
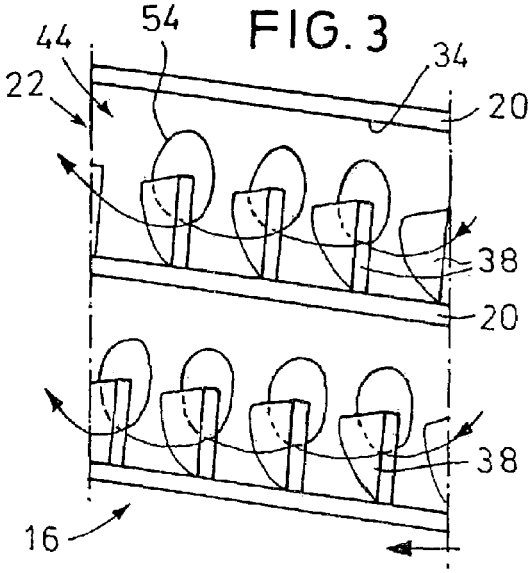
FIG. 3 shows a side view of a portion of the rotor of the pump of FIG. 17.

As illustrated particularly in FIGS. 2*a* and 3, the fluid is accelerated in circumferential direction of the rotor by the blade 38. Because of the acceleration, the centrifugal force acting upon the fluid is increased so that the fluid flows radially outward into the side channel 44. Finally, the fluid abuts against the fixed inside 26 of the stator housing wall 24 and is braked and reflected radially inward. During the deceleration at the inside of the stator housing wall 24, fluid flow 54 mixes with fluid particles from other channel sections, which have already been braked at the stator housing wall 24. In the radial inner portion of the pump channel 22 or in the region of the blade 38, the pressure is lower than in the radial outer portion of the pump channel 22, i.e., in the side channel 44. A force from the side channel 44 acts radially inward upon the fluid. Further, the braked fluid is peeled off the inside 26 of the stator wall by the channel wall front edge 34 and thus moved axially towards the fluid outlet 50 by the channel wall 20. From the side channel 44, the fluid flows along the suction-side channel wall side 32 of the channel wall 20 to the channel bottom 25 in which the fluid is again deflected radially outward by approximately 180°. In doing so, it is seized by the blade 38 and accelerated in the circumferential direction again. This process is repeated until the thus compressed fluid reaches the outlet-side axial end of the rotor 16 and flows out of the fluid outlet 50 there. In the fluid pump channel 22, a helical fluid flow 54 is thus generated in the course of which the fluid is increasingly compressed. By means of the described pump, gaseous fluids can be compressed from ultrahigh vacuum to approximately atmospheric pressure by a single compression stage.

The present vacuum pump 10 can be realized with a pump channel 22 of substantially any length so that very high compression capacities are achievable. Owing to the continuous fluid compression, loss-inflicted transitions between different compressor stages are avoided. The system-determined short circuit between the pressure side and the suction side that exists with conventional side channel compressors that have annular pump channels is eliminated in the screw thread-like pump channel arrangement. Apart from the inside 26 of the stator housing wall 24, all walls of a pump channel 22 are configured so as to be rotating, i.e., to compress the fluid. Thereby, the compression capacity of the present vacuum pump is increased as well. The flow of the delivered fluid has a low pulsation level. Due to the few movable parts and the simple structure, the present vacuum pump can be manufactured inexpensively and requires only a small extent of maintenance.

Figure 4:
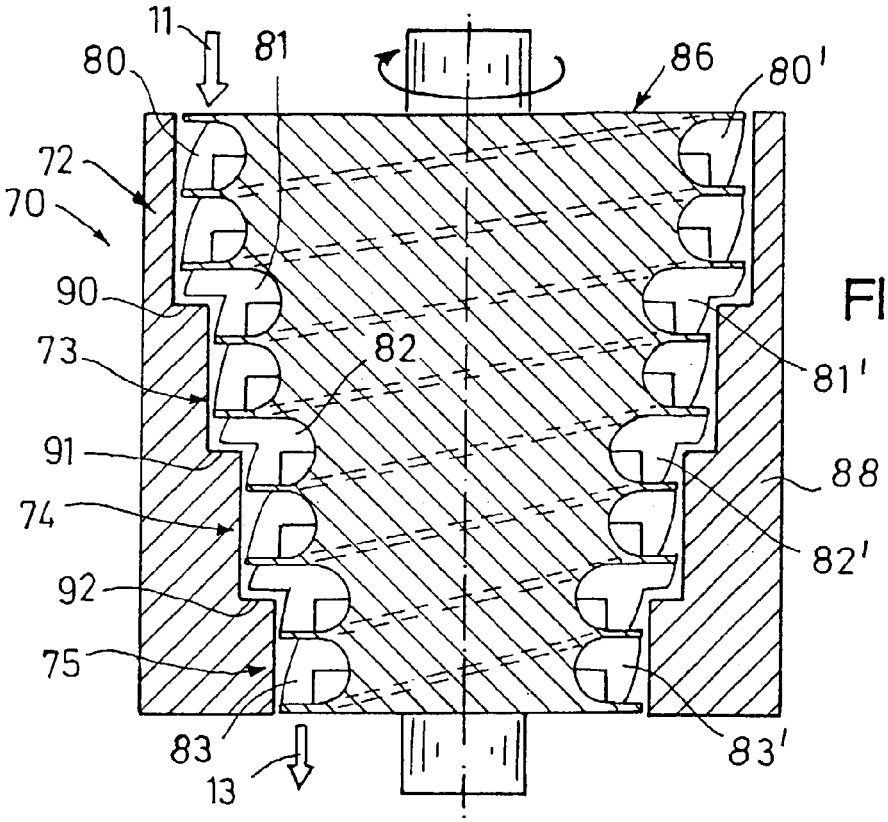
FIG. 4 shows a second embodiment of a side channel pump with several pump channels arranged behind each other in a step-like manner.

In FIG. 4, a second embodiment of a double-lead side channel pump 70 is illustrated, where four steps 72, 73, 74, 75 with pump channels 80–83, 80'–83' of different diameters are provided. Each step 72–75 comprises two parallel pump channels 80, 80'; 81, 81'; 82, 82'; 83, 83', by which the suction capacity of the pump 70 is doubled in comparison with single-lead pumps. A rotor 86 as well as the a stator housing wall 88 are configured so as to be stepped such that the radius of the pump channels 80–83 respectively decreases to the pressure side 13 from step to step, whereas the cross-sectional area of the pump channels 80 B 83, 80'–83' respectively remains the same. The height of each radial step 90, 91, 92 amounts to about one third of the radial height of a pump channel 80–83, 80'–83'. By limiting the height of the radial step to half of the radial pump channel height at maximum, the screw thread-like course of the pump channel is largely preserved in the region of the radial steps 90–92 as well. In this way, it is ensured that the helical fluid flow is substantially undisturbed. Moreover, a considerable pressure loss in the region of the radial steps 90–92 is avoided. Owing to the reduction of the pump channel radius towards the pressure side 13, the friction losses between the rotor 86 and the stator housing wall 88 are reduced.

Figure 5:
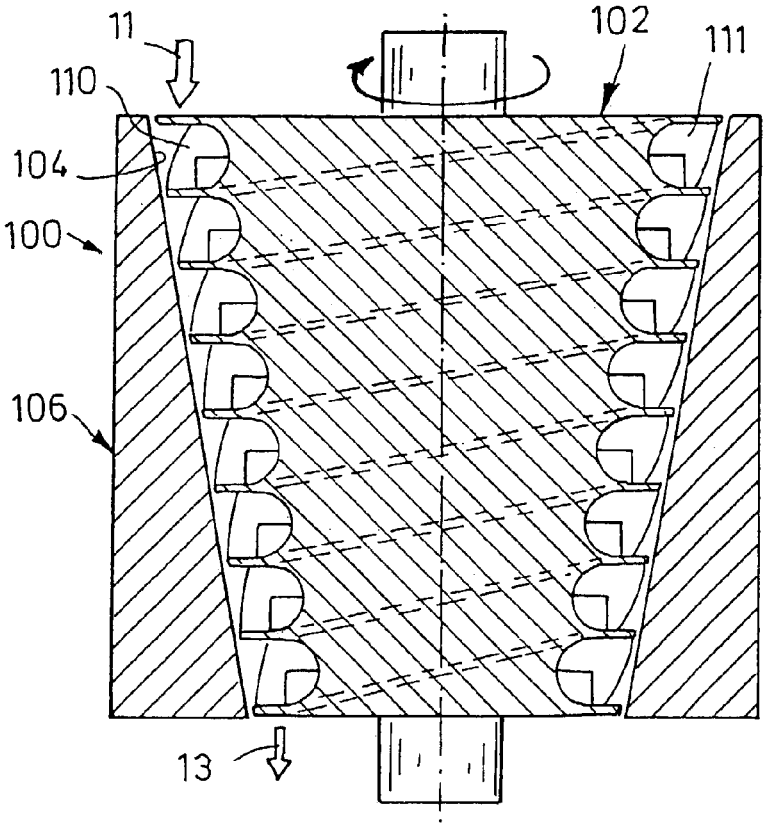
FIG. 5 shows a third embodiment of a pump being a side channel pump with a conical rotor and a conical stator.

In FIG. 5, a third embodiment of a side channel pump 100 is illustrated where a rotor 102 as well as a housing wall inside 104 of a stator 106 are configured so as to conically taper from the suction side 11 to the pressure side 13. The rotor 102 comprises two pump channels 110 and 111 arranged next to each other on the rotor outside in a helical manner. The radial height of the two parallel pump channels 110, 111 is constant over the entire length of the pump channels 110, 111. By the tapering the rotor 102 and the stator 106 towards the pressure side, friction between rotor 102 and stator 106 is reduced.

In a fourth embodiment of a side channel pump 120 illustrated in FIG. 6, an inside 122 of a stator housing wall 124 has a cylindrical configuration. An envelope formed by a rotor 125, which envelope is defined by outer ends of the channel walls 126, is cylindrical as well. The radial height as well as the axial width of the pump channels 128, 128' continuously decrease from the suction side 11 towards the pressure side 13 so that the slope of the pump channels 128, 128' decreases towards the pressure side. Due to the continuous reduction of the pump channel cross-section towards the pressure side 13, the pump channel length can be considerably extended, with the axial rotor length remaining constant, to enable a more compact design. The reduction of the pump channel cross-section towards the pressure side 13 is effected approximately analogously to the increase in pressure of the fluid in the two pump channels 128, 128'. Thus, it is taken into consideration that the fluid needs less and less space due to the continuous compression in the pump channels 128, 128' towards the pressure side 13.

Figure 7:
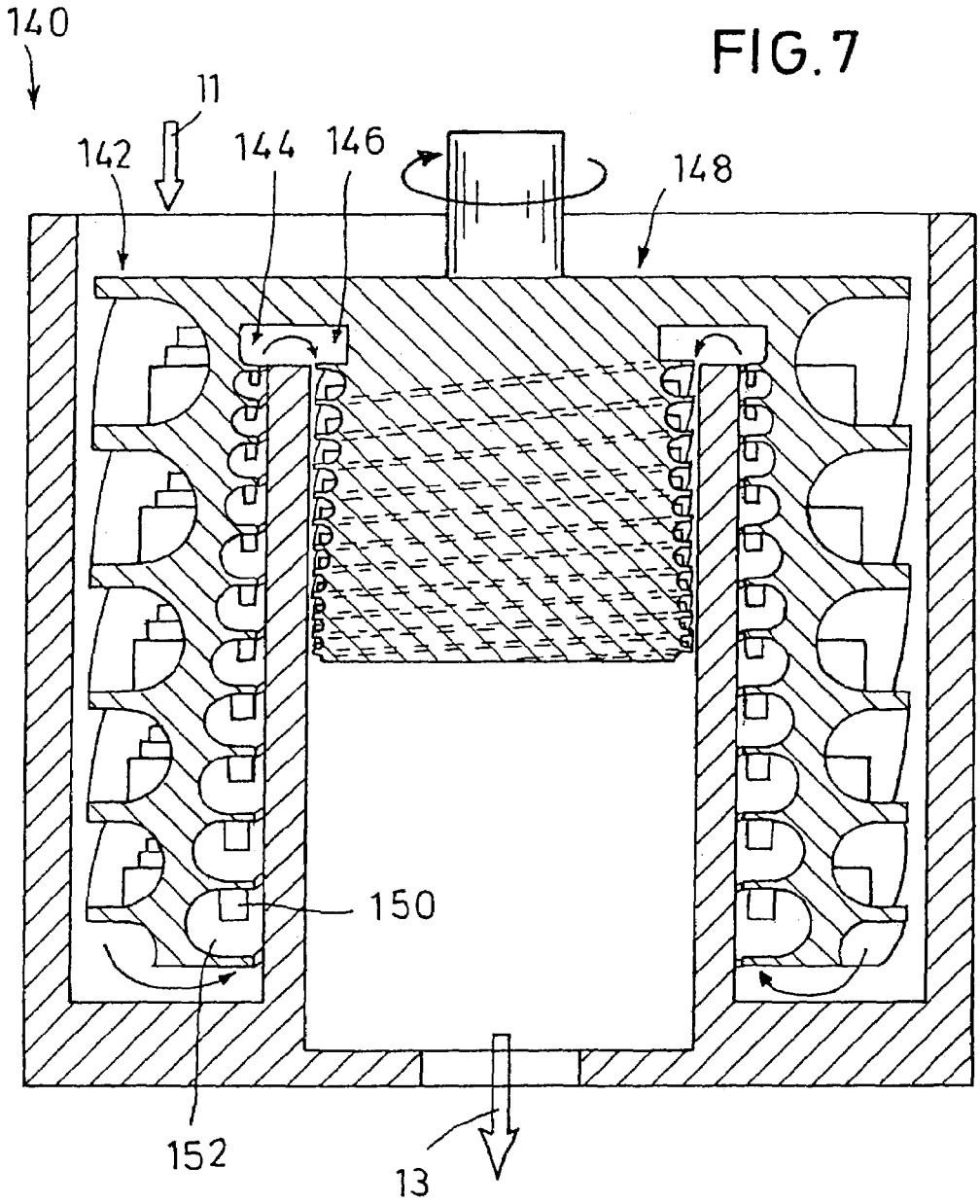
FIG. 7 shows a fifth embodiment of a side channel pump with a meander-like arrangement of several pump channels.

In a fifth embodiment of a pump 140 illustrated in FIG. 7, three pump channel ducts 142, 144, 146 are arranged in a meander-like manner and so as to be nested into each other. Thus, the axial length of rotor 148 can be considerably reduced. In the central pump channel duct 144, wings 150 are arranged in the pressure-side and radially inner quarter of the pump channel cross-section. Thereby, a helical fluid flow is also generated in the pump channel 152 of the central pump channel duct 144.

Figure 8:
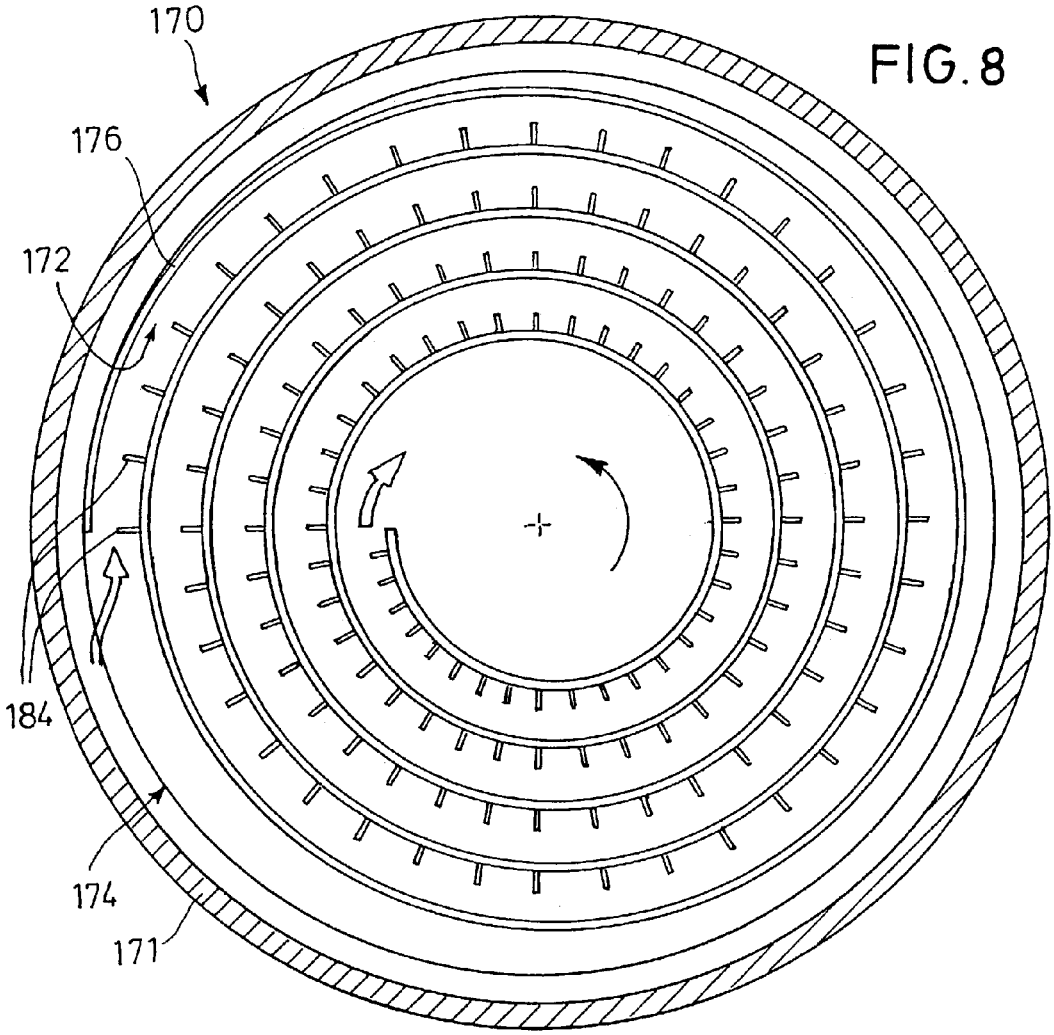
FIG. 8 shows a top view of a sixth embodiment of a side channel pump, with a spiral pump channel arranged on the rotor side.
Figure 9:
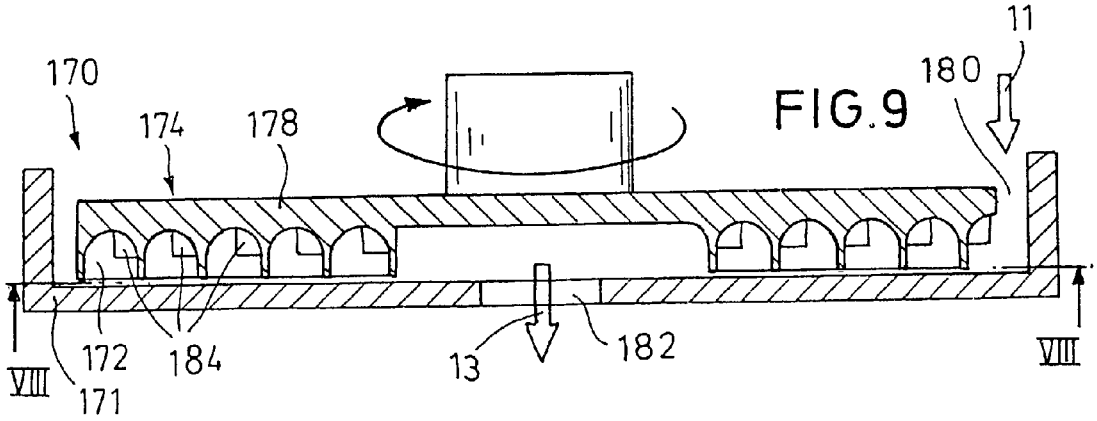
FIG. 9 shows a longitudinal cross-sectional view of the vacuum pump of FIG. 8.

In FIGS. 8 and 9, a sixth embodiment of a pump 170 being side channel pump is illustrated where a pump channel 172 is arranged spirally on an end face of a rotor 174 in a cross-sectional plane of the rotor 174. The pump channel 172 is radially defined by a channel wall 176 arranged spirally on rotor body 178, extending over five windings. The channel wall 176 and the pump channel 172 preferably follow a logarithmic spiral. In the illustrated pump 170, a fluid inlet 180 at the suction side 11 is located at the outer circumference of the rotor 174, and a fluid outlet 182 at the pressure side 13 is located in the center of the rotor 174. In the pump channel 172, blades 184 in the form of a segment of a circle of 90° are arranged at the inner channel wall side. The pump channel 172 defined by the channel wall 176 and the rotor body 178 is axially defined by a substantially disk-shaped stator housing 171. The compression of the fluid in the pump channel 172 is effected in the same manner as in the afore-described side channel pumps of FIGS. 1–7.

Figure 10:
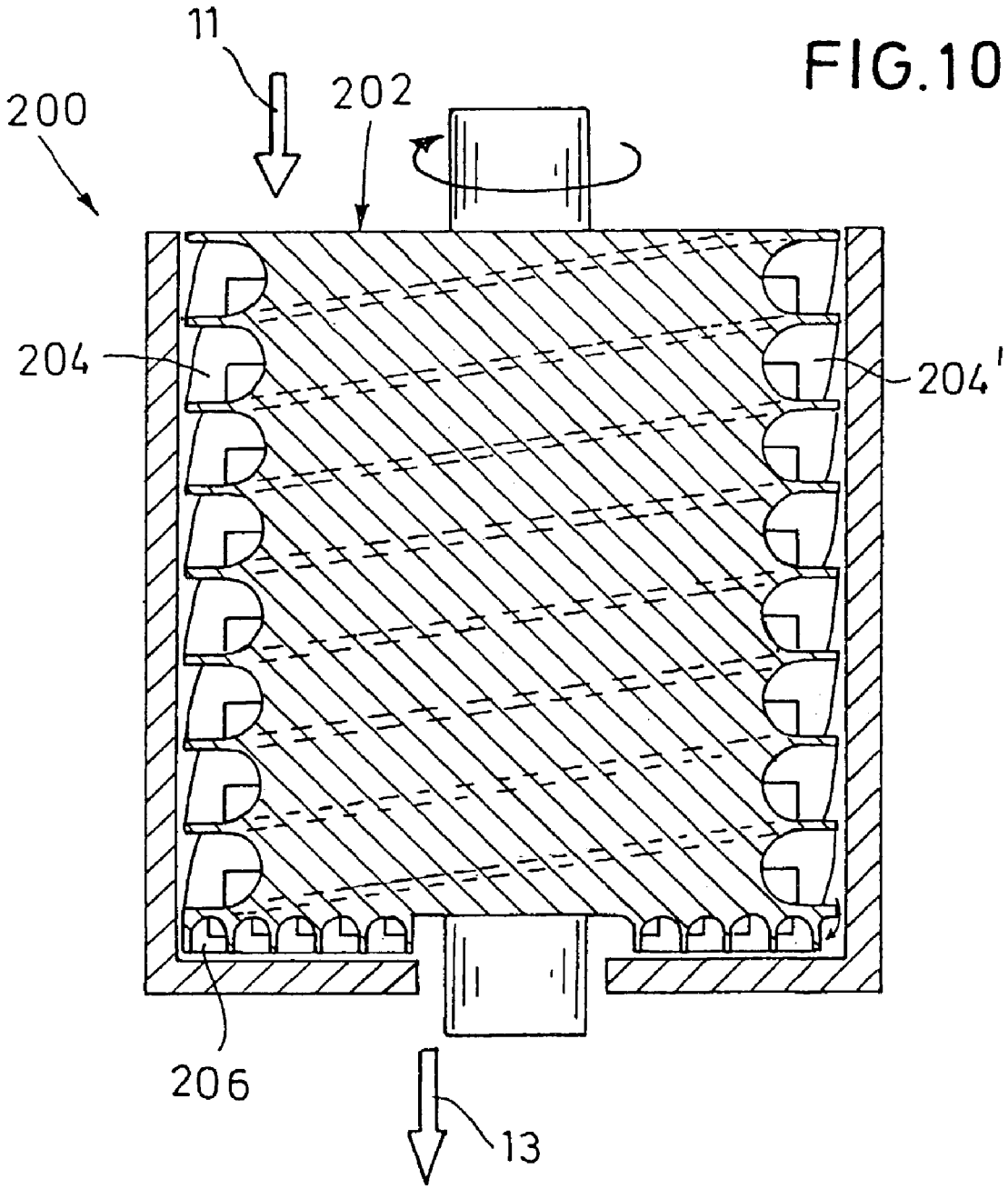
FIG. 10 shows a cross-sectional view of a seventh embodiment of a side channel pump, which has a pump channel arranged on the outer circumference of the rotor and an annexed pump channel arranged on the rotor end face.

In a seventh embodiment of a side channel pump 200 illustrated in FIG. 10, two helical pump channels 204, 204' are combined with a spiral pump channel 206 annexed thereto on a single rotor 202.

In FIGS. 11–14, two exemplary arrangements for providing fluid cooling are illustrated. In each exemplary arrangement, fluid is led out of the respective pump channel, cooled in a cooling channel and finally supplied to the pump channel again.

Figure 11:
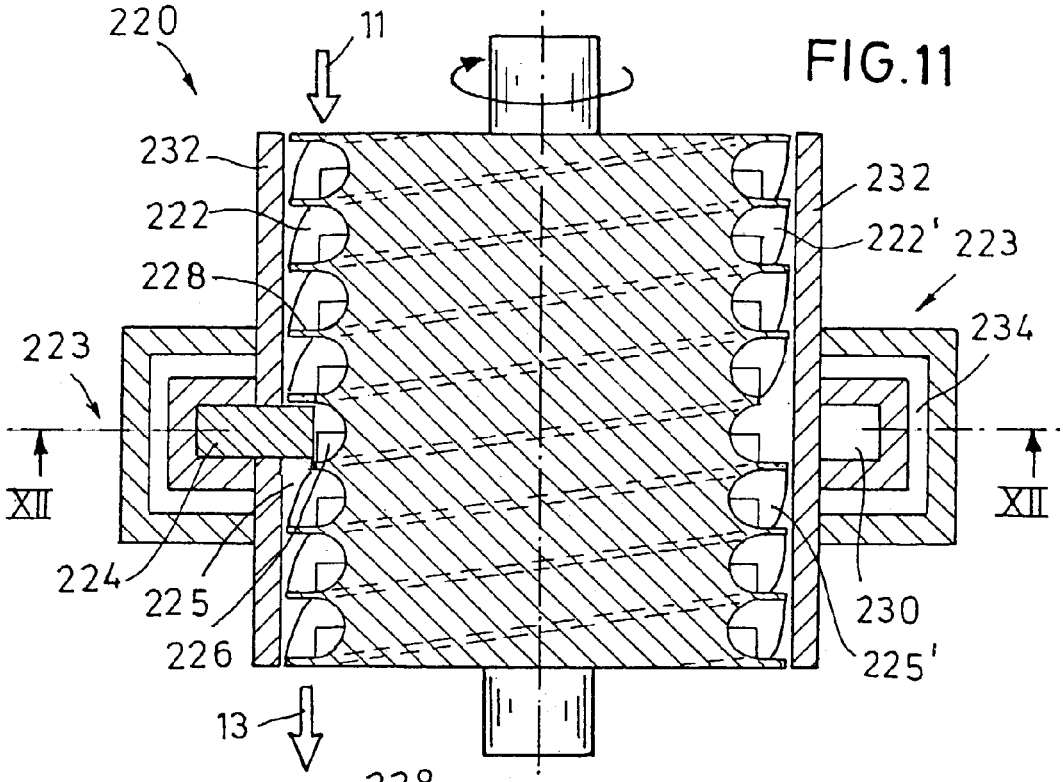
FIG. 11 shows a cross-sectional view of an eighth embodiment of a a side channel pump, which has a fluid cooling channel.
Figure 12:
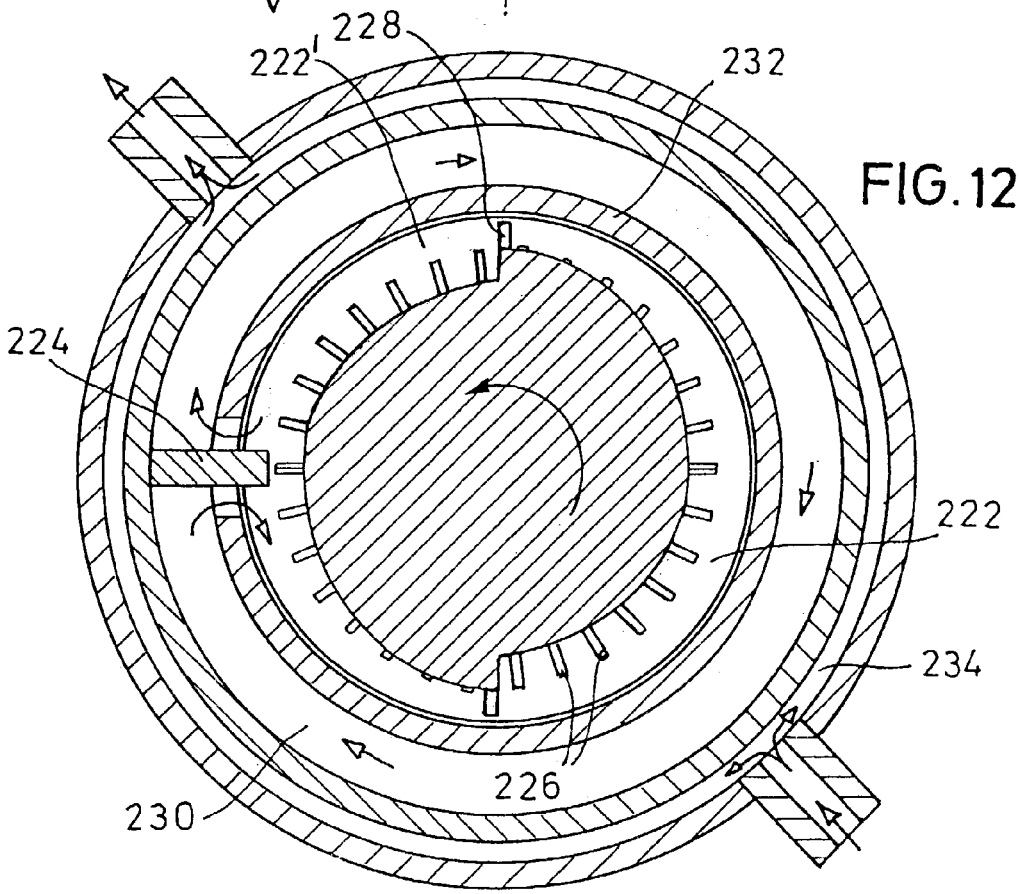
FIG. 12 shows a cross-sectional view taken along the sectional line XII—XII of the pump of FIG. 11.

A first embodiment incorporating fluid cooling in a side channel pump 220 is illustrated in FIGS. 11 and 12. The pump 220 includes two parallel pump channels 222, 222'. A fixed strip-shaped scraper 224 disposed on a cylindrical stator wall 232 protrudes radially into the two parallel pump channels 222, 222'. The scraper 224 has an axial length approximately corresponding to an axial width of a channel and approximately protrudes to half the radial height of the pump channels 222, 222' to blades 226 into the pump channel 222. In the region of the scraper 224, a channel wall 228 is limited to the radial height of the blades 226 so that it does not collide with the scraper 224. By the scraper 224, about half of the delivered fluid is led out of the pump channels 222, 222' and led into a cooling channel 230 of a cooling device 223. The cooling channel 230 extends about the cylindrical stator wall 232 and is, in turn, surrounded by a cooling agent channel 234. In the cooling agent channel 234, a cooling agent flows by which the cooling channel 230 and the fluid flowing therein are cooled. The cooling channel 230 and the cooling agent channel 234 extend annularly about the stator housing wall 232. At the rear side of the scraper 224, the cooled fluid coming from the cooling channel 230 flows into pump channels 225, 225' again. By the cooling device 223, about half of the fluid from the pump channels 222, 222' is led into the cooling channel 230. The other half of the fluid in the region of the blades 226 passes the scraper 224 and thus the cooling device 223 in a non-cooled manner. While only about half of the fluid is cooled, advantageously the helical fluid flow in the pump channels 222, 222', 225, 225' is only insignificantly disturbed.

Figure 13:
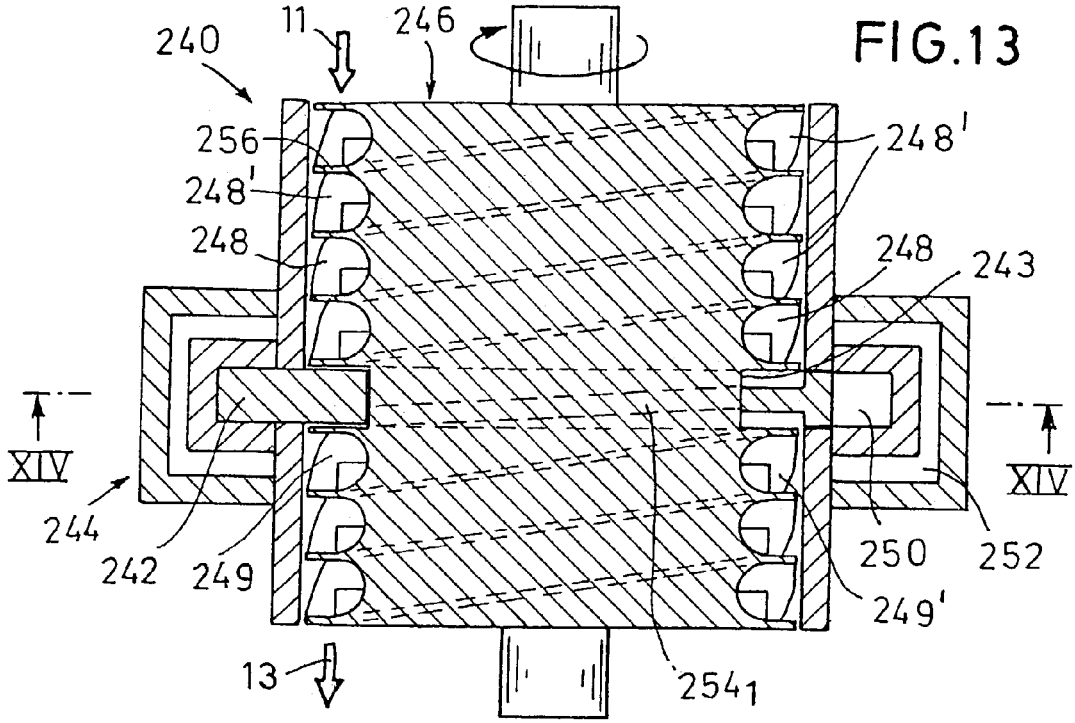
FIG. 13 shows a cross-sectional view of a ninth embodiment of a side channel pump, which has a fluid cooling channel.
Figure 14:
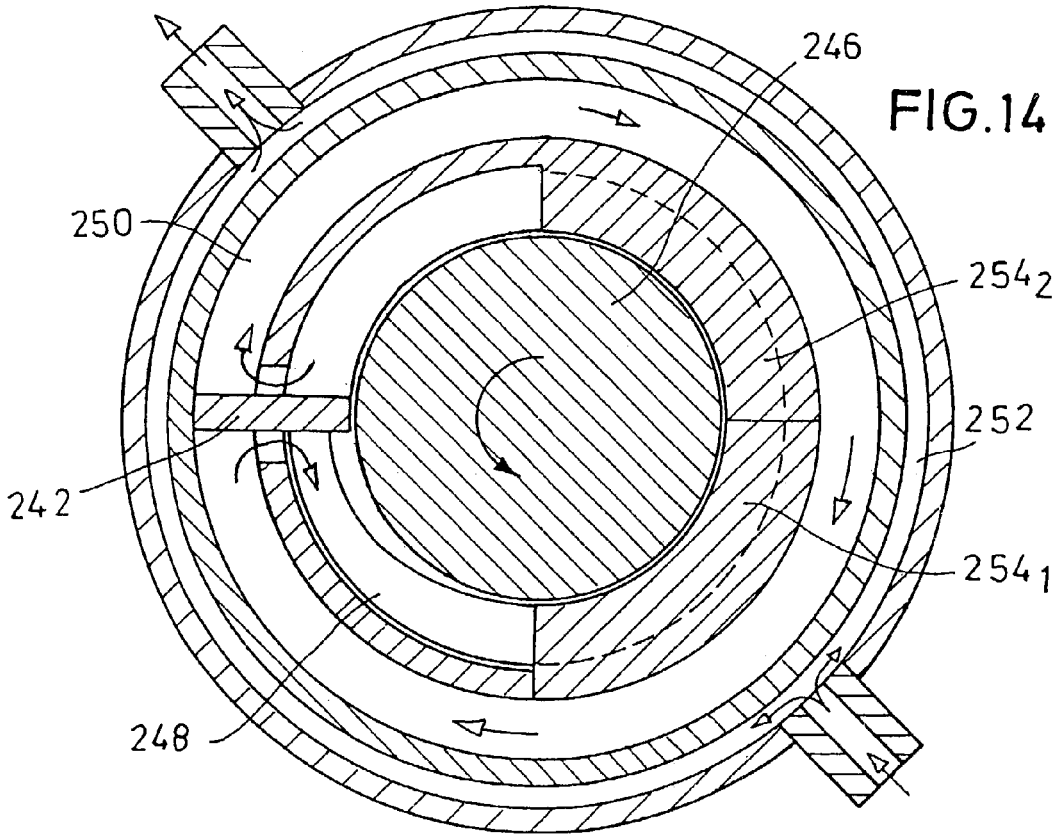
FIG. 14 shows a cross-sectional view taken along the sectional line XIV—XIV of the pump of FIG. 13.

In a second embodiment of a side channel pump 240 illustrated in FIGS. 13 and 14 that incorporates fluid cooling, a scraper 242 of a cooling device 244 radially protrudes beyond the complete radial height of pump channels 248, 248' into a rotor 246. The scraper 242 protrudes into a circumferential annular groove 243 of the rotor 246. Thus, the entire fluid flow from the pump channels 248, 248' is branched off into a cooling channel 250 and cooled there. The cooling channel 250, in turn, is surrounded by a cooling agent channel 252. In order to reduce pulsations of the fluid flow, a two-part guide ring $\mathbf{254}_1$, $\mathbf{254}_2$ protrudes into the annular groove 243. The guide ring $\mathbf{254}_1$, $\mathbf{254}_2$ consists of two half rings $\mathbf{254}_1$, $\mathbf{254}_2$ and is configured so as to extend helically in the same direction as channel walls 256. In this arrangement, the fluid flow can gradually flow out of the pump channels 248, 248' before impinging onto the scraper 242, before it is deflected into the cooling channel 250 by the scraper 242. After the fluid has passed the cooling channel 250, it is supplied to pump channels 249, 249' again along the guide ring $\mathbf{254}_2$. Thus, the entire fluid flow is led out of the pump channels 248, 248', cooled and introduced into the following pump channels 249, 249' again, without the occurrence of strong pulsations. Thus, a fluid intermediate cooling can be realized that causes only minor pressure losses.

In addition or as an alternative to the afore-described fluid cooling, the stator housing can be cooled by a cooling device. To this end, the stator housing can be surrounded, over its entire circumference and its entire length, by one or several cooling channels in which a cooling liquid, a cooling gas or another cooling agent flows around the stator housing.

Through the fluid cooling, the fluid compression approaches an isothermal compression, whereby, in turn, the required rotor power is reduced.

The invention has been described with reference to the preferred embodiments. Obviously, modifications and alterations will occur to others upon reading and understanding the preceding detailed description. It is intended that the invention be construed as including all such modifications and alterations insofar as they come within the scope of the appended claims or the equivalents thereof.

The invention claimed is:

1. A pump being a side channel pump, comprising:

an inlet through which fluid is received;

a driven rotor;

a stator, a helical pump channel configured in the rotor and defined by a radially outwardly protruding channel wall extending helically around the rotor, the pump channel being further defined by the stator;

blades fixed to the rotor and protruding into a portion of the pump channel;

a blade-free side channel portion forming a helical side channel defined in the pump channel; and, an outlet, fluid received through the inlet being pumped as the rotor rotates through the outlet.

2. The pump of claim 1, wherein the pump channel has more than one winding.

3. The pump of claim 1, wherein the pump channel continuously extends over substantially an entire rotor length, and the fluid inlet and the fluid outlet are defined at an end face of the rotor.

4. The pump of claim 1, wherein the rotor includes:

a plurality of channel walls extending from the rotor that define at least two pump channels arranged parallel to each other.

5. The pump of claim 1, wherein a surface area of each blade has a cross-sectional area that is between one-fifth and one-half of a cross-sectional area of the pump channel.

6. The pump of claim 1, wherein the stator surrounds the rotor.

7. The pump of claim 1, wherein the rotor surrounds the stator.

8. The pump of claim 1, wherein the channel wall is inclined to a radial line of the rotor.

9. The pump of claim 1, wherein each of the blades is inclined to a radial line of the rotor.

10. The pump of claim 1, wherein the pump channel has a cross-section that is larger at a suction side than at a pressure side of the pump channel.

11. The pump of claim 10, wherein the pump channel includes at least one radial step.

12. The pump of claim 11, wherein a height of the at least one radial step is smaller than one-half of a radial height of the pump channel.

13. The pump of claim 10, wherein the stator has a conical configuration.

14. The pump of claim 1, wherein the helical pump channel includes two helical pump channel sections, the pump further including:

a cooling channel arranged between the two pump channel sections.

15. A side channel pump comprising:

a rotor with a pump channel extending helically along and a plurality of revolutions around the rotor;

a stator having a smooth surface facing the helical pump channel;

blades fixed to the rotor and protruding into the pump channel; and a blade-free side channel portion forming a helical side channel defined in the pump channel, relative rotation of the rotor and the stator pumping a fluid from a suction side of the pump channel disposed in a fluid communication with an inlet to a pressure side of the pump channel in fluid communication with an outlet.

16. A pump including:

a stator;

a rotor that includes a channel wall protruding from a surface of the rotor, the channel wall including at least two helical or spiral channel wall turns that cooperate with a surface of the stator to define a helical or spiral pump channel that extends from a fluid inlet to a fluid outlet; and a plurality of blades secured to the rotor and extending into the pump channel, the blades occupying a limited portion of a cross-sectional area of the pump channel, the cross-sectional area of the pump channel further including a pump channel portion into which the blades do not extend forming a helical or spiral side channel.

17. The pump as set forth in claim 16, wherein:

the spiral pump channel has a logarithmic spiral shape.

* * * * *